US005129562A

United States Patent [19]

Bianchi

[11] Patent Number: 5,129,562

[45] Date of Patent: Jul. 14, 1992

[54] TRIGGER GUARD RETAINER

[75] Inventor: John E. Bianchi, Temecula, Calif.

[73] Assignee: Bianchi International, Inc., Temecula, Calif.

[21] Appl. No.: 608,082

[22] Filed: Nov. 1, 1990

[51] Int. Cl.[5] ..... F41C 33/02

[52] U.S. Cl. ..... 224/244; 224/253; 224/911

[58] Field of Search ..... 224/243, 244, 911, 253

[56] References Cited

U.S. PATENT DOCUMENTS

| | | | |
|---|---|---|---|
| 4,256,243 | 3/1981 | Bianchi et al. | 224/244 |
| 4,277,007 | 7/1981 | Bianchi et al. | 224/244 |
| 4,846,384 | 7/1989 | Perry | 224/244 |
| 4,925,075 | 5/1990 | Rogers | 224/244 |
| 4,934,574 | 6/1990 | Salandre | 224/244 |
| 5,018,654 | 5/1991 | Rogers et al. | 224/244 |

*Primary Examiner*—Linda J. Sholl
*Attorney, Agent, or Firm*—Wagner & Middlebrook

[57] ABSTRACT

A holster for a handgun having a trigger guard is formed of material such as leather which is folded upon itself to make a pocket, with an opening at the top. The edges of the material are sewn together with a narrow strip of the material therebetween to increase the volume of the pocket. A pair of openings are located on opposite sides of the pocket adjacent the position of the trigger guard when the handgun is in the pocket. A latch member of low friction material having resilient arms and clamp members with inwardly extending projections is fastened in the holster such that the arms and clamp members extend through the openings. When the handgun is placed in the holster, the trigger guard pushes past the projections on the clamp members which then latch around the trigger guard securing the handgun in the holster.

13 Claims, 2 Drawing Sheets

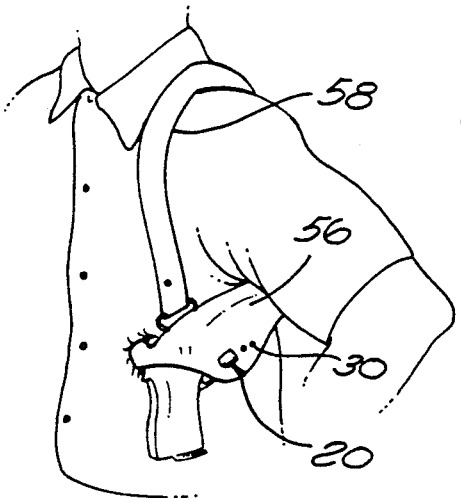
FIG. 5
FIG. 6
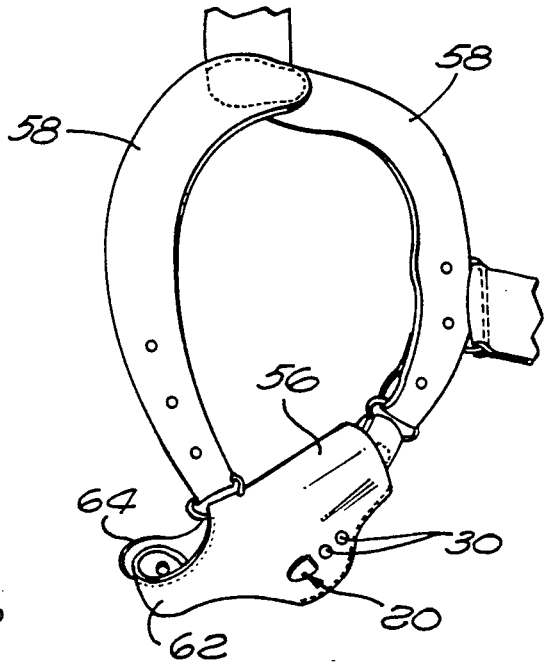
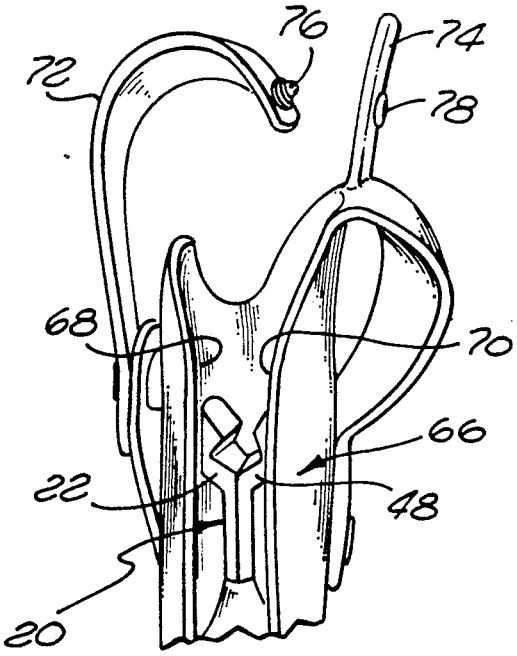
FIG. 7
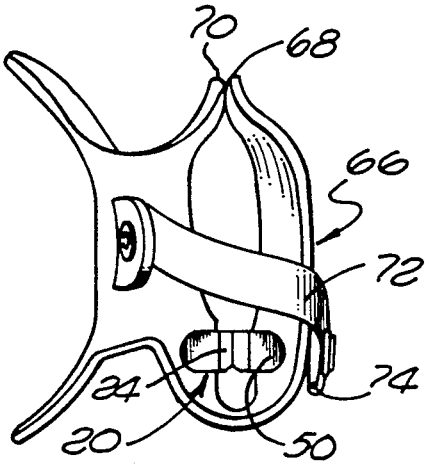
FIG. 8

TRIGGER GUARD RETAINER

BACKGROUND OF THE INVENTION

There has been a recognized need for a latch mechanism for both top opening and removal holsters and front opening holsters which will prevent the weapon from falling out of the holster during strenuous activities. This need has become particularly apparent with the present trend toward open top or non-flap holsters for use by law enforcement officers. In recognition of this need, a holster providing a hesitation lock for use in top opening and top removal holsters was designed by the applicant herein and another which became the subject of U.S. Pat. No. 4,256,243. The holster designed in that patent employs a relatively thin spring secured between the body and liner of the holster at a point spaced from the trigger of the weapon. The opposite end of the spring member supports a protuberance in the form of a dome shaped member of low friction material dimensioned to fill approximately the front half of the trigger guard of the handgun for which the holster is designed. A somewhat similar structure employed in a front opening holster is disclosed in Bianchi et al U.S. Pat. No. 4,277,007. While the latch arrangement employed in the above two patents is effective for its intended purpose, it is somewhat time consuming and expensive to manufacture. There is, therefore, a need for a holster providing a hesitation lock or latch for top opening and removal holsters as well as front opening holsters which is compact and lightweight, significantly less expensive to manufacture than the prior art designs, which requires no manual release for operation, which has no parts to break and which does not detract from the appearance of the holster.

BRIEF DESCRIPTION OF THE INVENTION

Applicant has provided a new and inexpensive latch mechanism of low friction material which, in addition to other safety features, provides an added means to retain a handgun in its holster throughout normal strenuous actively but which has a resistance to deflection insufficient to prevent or significantly inhibit withdrawal of the handgun by the user. The latch is secured to the holster pocket and includes somewhat resilient outwardly extending arms to which are attached inwardly extending projections. These projections have tapered surfaces which are contacted by the trigger guard of the handgun when it is placed in the holster and caused to spread and then snap together behind the trigger guard to hold the handgun in position. When it is desired to remove the handgun from the holster, only a limited force is required of the user to deflect the arms and, hence, the projections, to pull the trigger guard through the latch. Additional straps may be incorporated in the holster to further hold the handgun in the holster and to prevent cocking of the handgun hammer. This latch mechanism is applicable to several types of holsters including top opening and removal types, forward draw types, and shoulder holsters. It is usable with holsters of leather, plastic or the recently available nylon types which are typically of a composite fabric-foam-fabric material.

BRIEF DESCRIPTION OF THE DRAWING

FIG. 5 is a view from the side of a shoulder holster incorporating the latch mechanism of my invention;

FIG. 6 is a perspective view, somewhat enlarged, of the shoulder holster of FIG. 5;

FIG. 7 is a front elevational view of a front draw type holster incorporating the latch mechanism of my invention; and FIG. 8 is a top elevational view of the holster of FIG. 7.

DETAILED DESCRIPTION OF THE INVENTION

Figure 1:
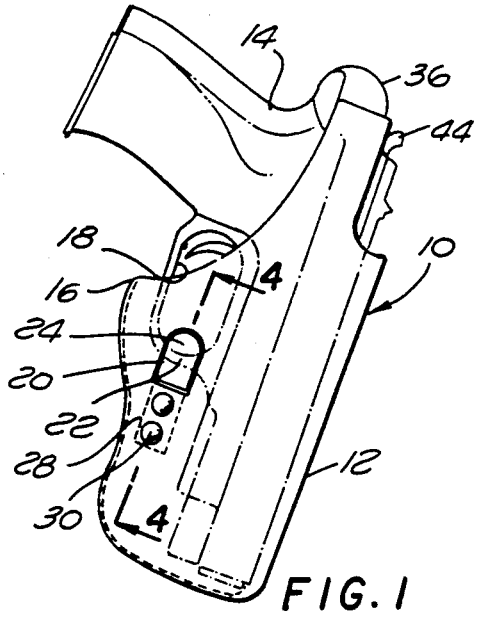
FIG. 1 is a plan view, partly in phantom, of a top opening and top removal holster incorporating my invention with a handgun secured therein.

Referring to FIG. 1, a holster shown generally at numeral 10 includes a member 12, preferably of leather, folded at one side adjacent the top of the handgun 14 and sewn together on the bottom and opposing edges at 16. The handgun 14, which is shown as an automatic pistol, but which could also be a revolver, includes a trigger guard 18 held in the pocket of the holster 10 by means of a latch 20. A portion of the latch including part of an outwardly extending arm 22 and a clamp member 24 having an inwardly extending projection portion are shown extending through an opening 26 in the side of the holster adjacent the trigger guard 18. Latch 20 includes a leg member 28 secured to folded member 12 by means of suitable fastening members such as post screws 30 or rivets or may be formed or molded of one or more pieces not necessarily requiring rivets.

Figure 2:
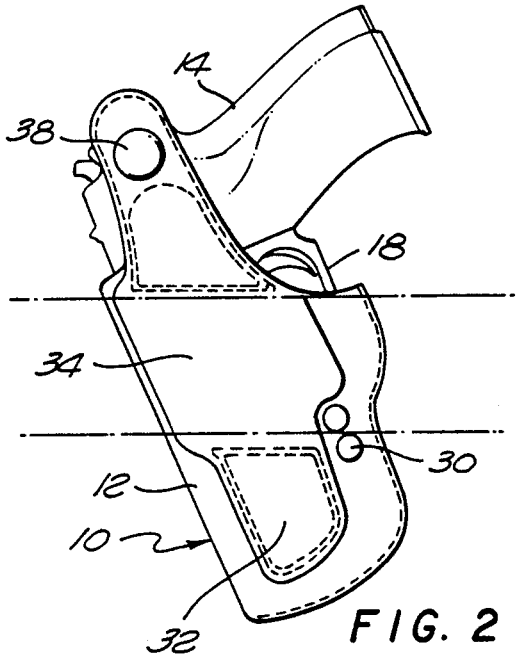
FIG. 2 is a view from the rear of the holster and handgun of FIG. 1.

FIG. 2 shows the opposite side of holster 10 and member 12 to which is attached by means of a double row of stitching, a second member 32. Member 32 is attached to member 12 in such manner as to leave a space 34, indicated by the dash-dot lines for insertion of a belt.

Figure 3:
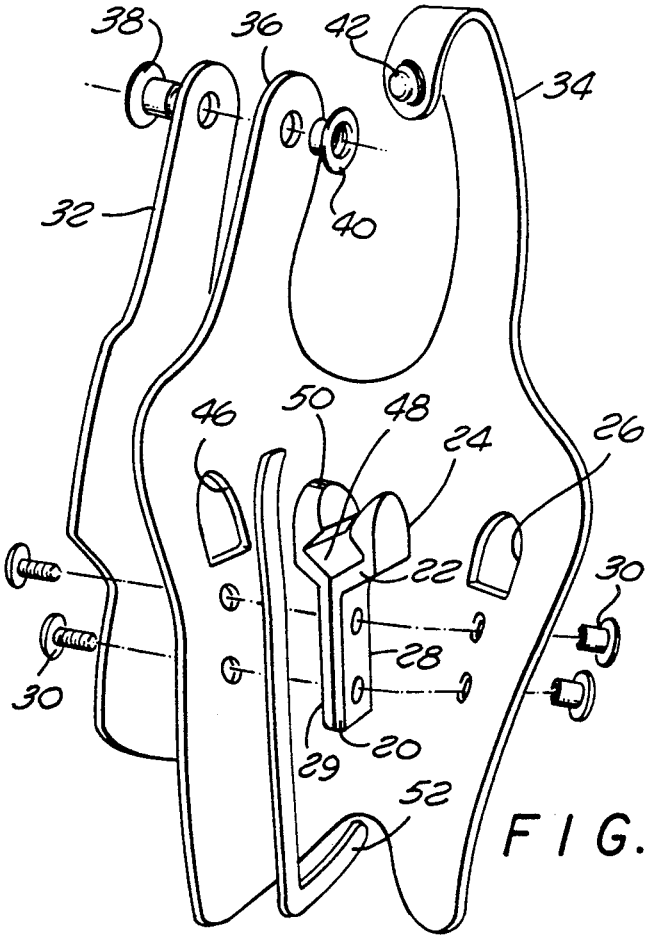
FIG. 3 is an exploded view of the holster of FIGS. 1 and 2.

FIG. 3 is an exploded view of the holster of FIGS. 1 and 2. In this view it will be seen that member 12 is formed with a pair of longitudinal extensions 34,36 which constitute straps. Member 32 includes an elongated extension which is sewn to strap 36, making the combined strap structure relatively stiff. A snap fastener is attached at the ends of the straps including a female part consisting of a cap 38 and socket 40 secured through holes in strap 36 and member 32 and a mating member 42 fastened to strap 34. The straps and snap fastener provide a means to firmly hold the handgun 14 in the holster 10 while also securing the hammer 44 in its uncocked position. In this exploded view the opening 26 is shown in the front face of member 12 and a similar opening 46 in the rear face. The trigger guard latch 20 is shown positioned between openings 26 and 46 including the outwardly extending arm 22 and clamp member 24 which extends into and through opening 26. Latch 20 also includes a matching piece, which is normally identical including a supporting leg 29, an outwardly extending arm 48 and a clamp member 50 which extends into and through opening 46. Legs 28,29 of latch 20 are secured to member 12 by post screws 30 which pass through holes in the front and rear faces of member 12 and through holes in legs 28. Positioned between legs 28,29 is a spacer member 51 which may or may not be required. This spacer provides a ready means of compensating for varying widths of trigger guards and may be formed of any suitable material including metal. The latch itself is preferably formed of a strong plastic material such as Nylon, which is somewhat resilient and which is sufficiently soft that it will not mar the trigger guard while being sufficiently sturdy to withstand hundreds of cycles of removal and replacement of the handgun in the holster without excessive deformation. Alternatively, the latch halves may be formed with a spring wire stiffener with the plastic material molded around it so that the spring wire does not contact the trigger guard. Post screws 30 may, as stated above, be replaced by rivets. The post screws 30 do provide a ready means of changing latch 20 should it become worn or should one desire to replace the latch with one of slightly different dimensions such as could occur if the user should want to replace the handgun with one of slightly different configuration having, for example, a differently shaped trigger guard. To maintain the desired volume within the pocket of holster 10 and to prevent sharp bends of member 12 around legs 28, an additional thickness of leather or other suitable material 52 is sewn between the edges of member 12.

Figure 4:
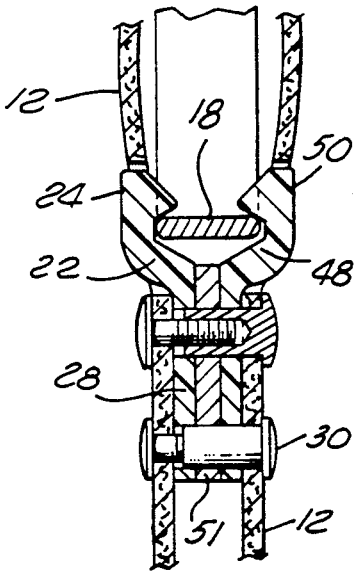
FIG. 4 is a sectional view taken along line 4—4 of FIG. 1.

FIG. 4 is a sectional view taken along line 4—4 of FIG. 1. This view cuts through the latch 20 and post screws 30 and shows the trigger guard 18 secured in position by means of the clamp members 24 and 50. With the handgun thus secured, the opportunity for its being inadvertently dislodged from the holster 10 even during strenuous activity is greatly reduced even if the snap fastener 40,42 is disengaged. The latch is easily able to support the handgun with the holster 10 in inverted position with the snap fastener members disengaged or even removed altogether.

FIG. 5 is a view from the side of a shoulder holster incorporating the latch 20 described above. In this view is shown a portion of the torso of an officer wearing a shoulder holster 56 supported on a harness 58, shown in part in this view. A pistol 60 is shown positioned in holster 56 and secured in position by means of a strap 62 and a thumb tab 64 (FIG. 6). In addition, the trigger guard of pistol 60 is retained by latch 20. FIG. 6 shows the shoulder holster 56 carried on harness 58 and with the pistol 60 removed. It will be recognized that latch 20 may be even more useful as incorporated into a shoulder holster since, in the event strap 62 and thumb tab 64 become disconnected, the pistol 60 would have a tendency to fall out of the holster 56.

FIG. 7 is a front elevational view of a front draw type holster 66 in the position in which it is found during the process of front drawing of a pistol. With the holster in its normal position, the front edges 68 and 70 are held fairly tightly together by means of resilient members (not shown) incorporated into the sides of the holster in a manner well known in the art. U.S. Pat. No. 4,277,007 referred to above describes such resilient members. Latch 20 is shown in position through the opening created when the pistol (not shown) is drawn through the front of the holster between edges 68 and 70. The arms 22 and 48 of latch 20 deflect as the pistol is drawn forwardly as well as from the top. Also shown are straps 72 and 74 with snap fastener members 76, 78, respectively, for securing the handgun. FIG. 8 is a top elevational view of the holster 66 of FIG. 7 and shows latch 20 as seen from the top and shows front edges 68 and 70 closed together as well as straps 72,74. Since, in this embodiment, the handgun would be drawn upwardly between edges 68 and 70, adjacent edges of the clamp members 24 and 50 are tapered to facilitate movement in that direction.

While a limited number of embodiments have been described herein, it is recognized that modifications will occur to those skilled in the art, and I do not desire to be limited other than by the scope of the following claims, including their equivalents.

What is claimed is:

1. A holster for a handgun including a trigger guard comprising:

a body of material folded upon itself to define a pocket for holding a handgun with an opening for the entrance and exit of the handgun;

a pair of openings in said material on opposite sides of said pocket adjacent the trigger guard of said handgun when said handgun is in said pocket; and a trigger guard retainer secured to said material, said retainer including a pair of outwardly extending arms and clamp members, said arms being somewhat resilient and said clamp members extending through said openings and including inwardly extending projections for retaining said trigger guard, said arms having sufficient resistance to bending to prevent the weight of the handgun from deflecting said clamp members and permitting the trigger guard to pass said projections when said holster is inverted.

2. A holster in accordance with claim 1 wherein said trigger guard retainer further includes supporting legs attached to said arms, and fastening means passing through the sides of said pocket and said legs for securing said retainer to said holster.

3. A holster in accordance with claim 2 wherein said trigger guard retainer is formed of two separate members of polytetrafluoroethylene material which are clamped together by said fastening means.

4. A holster in accordance with claim 1 wherein a second layer of material is attached to one side of said pocket, said second layer cooperating with said pocket to define a channel for passage of a belt to secure said holster to said belt and a third layer of material is formed as a strip and fastened between the folded over edges of said body of material to increase the width of said pocket.

5. A holster in accordance with claim 4 wherein said body of material includes strap portions extending longitudinally on each side of said opening, said second layer of material includes a longitudinal extension secured to one of said strap portions, and fastening means are provided for fastening the ends of said strap portions together to secure said handgun in said pocket.

6. A holster in accordance with claim 4 wherein said trigger guard retainer further includes supporting legs attached to said arms, and fastening means passing through the sides of said pocket and said legs for securing said retainer to said holster.

7. A holster in accordance with claim 6 wherein said trigger guard retainer is formed of two separate members of Nylon material which are held together by said fastening means.

8. A holster for a handgun including a trigger guard comprising:

a body of material folded upon itself to define a pocket for holding a handgun with an opening for the entrance and exit of the handgun, said material including strap portions on each side of said opening extending longitudinally to define securing and strap fastening means for holding said handgun in said pocket; and a spacing strip placed between the folded over edges of said material;

a pair of openings in said material on opposite sides of said pocket adjacent the trigger guard of said handgun when said handgun is in said pocket; and a trigger guard retainer secured to said material, said retainer including a pair of outwardly extending arms and clamp members, said arms being somewhat resilient and said clamp member and part of said arms extending through said openings, said clamp members including tapered inwardly extending projections for retaining said trigger guard, said arms having resistance to bending such that said handgun is prevented from being removed from said holster unless force is applied sufficient to spread said arms and pull said trigger guard past said inwardly extending projections.

9. A holster in accordance with claim 8 wherein said trigger guard retainer further includes supporting legs attached to said arms, and fastening means passing through the sides of said pocket and said legs for securing said retainer to said holster.

10. A holster in accordance with claim 9 wherein said trigger guard retainer is formed of two separate members of Nylon material which are held together by said fastening means.

11. A holster in accordance with claim 9 wherein said trigger guard retainer further includes a spacer member positioned between said supporting legs including passage means for receiving said fastening means.

12. A holster in accordance with claim 8 wherein a second layer of material is attached to one side of said pocket, said attaching means leaving a channel for passage of a belt to secure said holster to said belt, said second layer of material also including a longitudinally extending portion secured to one of said strap portions.

13. A holster in accordance with claim 12 wherein one of said strap fastener members is carried on and supported by said longitudinally extending portion and one of said strap portions.

* * * * *